US006207299B1

(12) United States Patent
Krauth et al.

(10) Patent No.: US 6,207,299 B1
(45) Date of Patent: Mar. 27, 2001

(54) SHEET METAL WITH AN ALUMINUM-CONTAINING COATING HAVING LOW EMISSIVITY

(75) Inventors: Pierre Jean Krauth, Yutz; Jean Philippe, Veckring, both of (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 08/943,282

(22) Filed: Oct. 3, 1997

(30) Foreign Application Priority Data

Oct. 10, 1996 (FR) ..... 96 12918

(51) Int. Cl.[7] ..... B32B 15/00
(52) U.S. Cl. ..... 428/653; 428/939
(58) Field of Search ..... 428/653, 939

(56) References Cited

U.S. PATENT DOCUMENTS

| | | | | |
|---|---|---|---|---|
| 4,542,048 | * | 9/1985 | Nickola et al. | 427/980 |
| 4,546,051 | | 10/1985 | Uchida et al. . | |
| 4,628,004 | * | 12/1986 | Nickola et al. | 428/413 |
| 4,629,865 | * | 12/1986 | Freedman et al. | 219/405 |
| 4,655,852 | | 4/1987 | Rallis . | |
| 4,678,717 | * | 7/1987 | Nickola et al. | 428/553 |

FOREIGN PATENT DOCUMENTS

| | | |
|---|---|---|
| 55-085623 | 6/1980 | (JP) . |
| 62-050454 | 3/1987 | (JP) . |
| 5-287492 | 11/1993 | (JP) . |
| 85/00386 | 1/1985 | (WO) . |
| 95/18245 | 7/1995 | (WO) . |

* cited by examiner

*Primary Examiner*—Timothy M. Speer
*Assistant Examiner*—Bryant Young
(74) *Attorney, Agent, or Firm*—Nixon Peabody LLP; Thomas W. Cole

(57) ABSTRACT

A coating layer for sheet metal is provided that is comprised of an aluminum-silicon alloy having low emissivity. The coated sheet metal may be used as heat shield material, particularly for heat sources having temperatures greater than 500° C., which sources may be, e.g., the hotter parts of the conduits of automotive exhaust systems. The sheet metal may be sheet steel coated on at least one of its principal surfaces with a layer of a coating comprised of an alloy of silicon in the amount of 7–11 wt. % and aluminum in the amount of 87–93 wt. %. The coated surface of the sheet has a monochromatic emissivity less than 0.15 for all wavelengths in the range of 1.5–15 microns.

3 Claims, 3 Drawing Sheets

SHEET METAL WITH AN ALUMINUM-CONTAINING COATING HAVING LOW EMISSIVITY

BACKGROUND OF THE INVENTION

The invention relates to the area of technology of sheet metal having an aluminum-containing coating. In particular, it relates to sheet metal having an aluminum-containing coating which coating comprises an aluminum-silicon alloy. Such coated sheet metal is used, e.g. to produce heat shields for the exhaust system conduits of automobiles.

The object of a heat shield is to insulate pieces disposed behind it from a source of heat disposed in front of it. Thus, a heat shield should have the minimum possible energy absorptivity; stated otherwise, it should have maximum repellence for incident energy. Such behavior is characterized by low emissivity of the constituent material; in other words, high reflectance. Thus, desirable heat shields are comprised of materials which have satisfactory mechanical properties, have good formability for fabrication purposes, and good resistance to corrosion, and further have low emissivity.

It is known to produce heat shields from sheet metal having an aluminum-containing coating which coating comprises an aluminum-silicon alloy. An example of such coated sheet metal is low carbon steel coated on its two principal surfaces with an aluminum-silicon alloy which is applied by passing the sheet into a bath of the fused alloy. During the passage of the sheet into the coating bath comprising the aluminum-silicon alloy, a layer of an iron-aluminum-silicon alloy develops. Accordingly, the metallographic cross section of the coating reveals the following structure:

- a surface layer having a composition close to that of the bath, and
- a subsurface layer comprising a ternary alloy, of composition $Fe_3Si_2Al_{12}$. Such sheet metal with an aluminum-containing coating has a low overall emissivity, less than 0.2, and thus a high reflectivity, greater than 80%. This characteristic is maintained at temperatures up to 450° C. The material is thereby of substantial engineering interest, for use for interior walls of industrial or household furnaces, heat reflectors for all manner of household appliances, or heat shields for conduits in automotive exhaust systems, but not for the relatively hotter such conduits.

A method of improving the properties of such materials is known wherein the material is passed through a roll stand or roll housing, known as a "skin-pass" stand, where it is cold-worked by means of smooth rolls. This process is capable of slightly reducing the emissivity of the material, but at the cost of degradation of desirable high-temperature properties.

The object of the present invention is to solve the above-described problem by devising a sheet metal having an aluminum-containing coating which coating comprises an aluminum-silicon alloy, wherewith said coated sheet metal has low emissivity and can be used as a heat shield for heat sources having temperatures above 500° C., e.g. conduits of which automotive exhaust systems are formed, including the hottest such conduits.

SUMMARY OF THE INVENTION

More particularly the invention relates to steel sheet coated on at least one of its principal surfaces with a layer of a coating comprised of an aluminum-based alloy comprised of aluminum and silicon, including silicon less than 11 wt. %, particularly comprising 7–11 wt. % silicon and 87–93 wt. % aluminum; characterized in that the coated surface has a monochromatic emissivity less than 0.15 for all wavelengths in the range of 1.5–15 microns. According to another feature, the coated surface has a monochromatic emissivity less than 0.10 for all wavelengths in the range of 5–15 microns, and a monochromatic emissivity in the range 0.10–0.15 for all wavelengths in the range of 1.5–5 microns.

The invention further relates to a method of fabricating steel sheet of the described type; characterized by the following steps:

- production of steel sheet coated on at least one of its principal surfaces by a layer of a coating in the solid state, which coating is comprised of an aluminum-based alloy comprised of aluminum and silicon, said alloy including silicon less than 11 wt. %, comprising 7–11 wt. % silicon and 87–93 wt. % aluminum;
- heating the coating layer to a temperature T1 which is greater than the fusion temperature T2 of said coating;
- maintaining the coating layer at the said temperature level T1 greater than the fusion temperature T2 of the coating, for a duration between 0 and 100 sec, preferably between 0 and 10 sec;
- cooling the sheet to a temperature at least equal to the limiting alloying temperature of alloying between the coating and the steel, and preferably cooling the sheet to the ambient temperature (room temperature).

According to other features:

- The temperature T1 to which the coating layer is heated is between the fusion temperature T2 of the coating layer and 650° C.
- The temperature T1 is 10–15° C. above the fusion temperature T2 of the coating layer.
- The rate of heating of the coating layer is in the range 20–100° C. per second.
- The cooling of the coated sheet metal is natural cooling in the open air, or "forced" radiative cooling.
- The cooling of the coated sheet metal is forced-air cooling.
- The cooling of the sheet metal is carried out in at least two stages, as follows:
  - natural cooling to the fusion temperature T2 of the coating; followed by
  - forced-air cooling to the limiting temperature of alloying between the coating and the steel.
- The sheet steel coated on at least one of its principal surfaces by a layer of a coating in the solid state, which coating is comprised of an aluminum-based alloy of a type comprised of aluminum and silicon, said alloy comprising silicon less than 11 wt. %, is fabricated by dip-coating a steel substrate in a fused bath comprising silicon 9–10 wt. %, iron c. 3 wt. %, and the remainder aluminum, and cooling the coated substrate to a temperature less than the fusion temperature T2 of the coating.

Finally, the invention relates to a heat shield comprised of a described coated sheet metal.

BRIEF DESCRIPTION OF THE DRAWINGS

The features and advantages of the invention will be made more evident with the aid of the following description of the accompanying two plates of drawings, offered solely by way of example.

BRIEF DESCRIPTION Of THE PREFERRED EMBODIMENT

Figure 1:
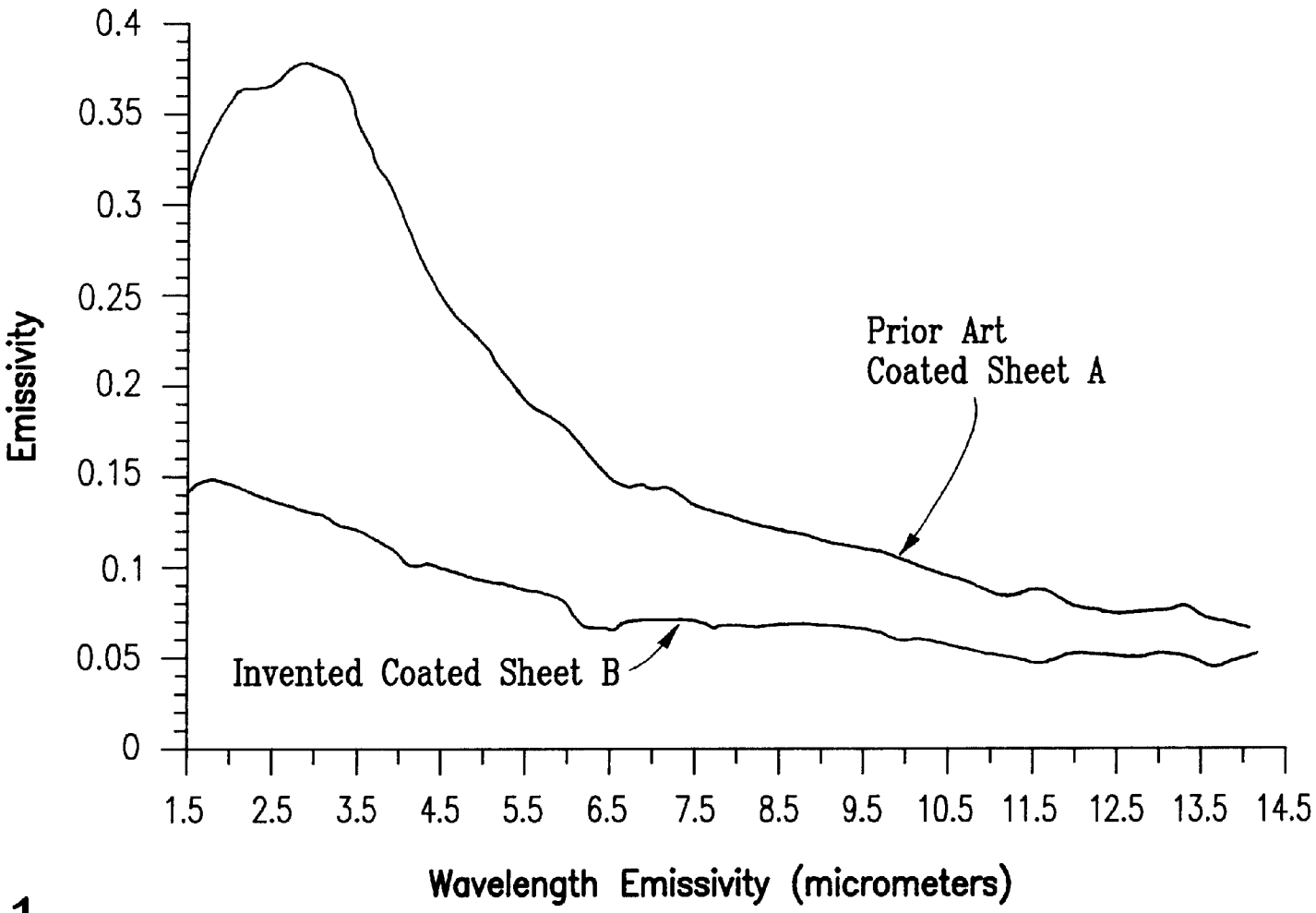
FIG. 1 is a plot representing the spectral emissivity of a metal sheet having an aluminum-containing coating, according to the invention, designated coated sheet B, and a corresponding plot for a coated sheet A according to the state of the art.

As seen from FIG. 1, the principal characteristic of the inventive coated metal sheet coated on at least one of its principal surfaces with an aluminum-containing coating comprised of an alloy of a type comprised of aluminum and silicon, said alloy comprising silicon less than 11 wt.%, is that the coated surface has a monochromatic emissivity less than 0.15 for all wavelengths in the range of 1.5–15 microns.

More precisely, the coated surface has a monochromatic emissivity less than 0.10 for all wavelengths in the range of 5–15 microns, and a monochromatic emissivity in the range of 0.10–0.15 for all wavelengths in the range 1.5–15 microns.

The term "monochromatic emissivity" is understood to mean the ratio of the luminance of the material at a given wavelength to the luminance of a theoretical black body at the same wavelength and temperature.

Such an inventive steel sheet having an aluminum-containing coating is fabricated in several stages.

In a first stage, a steel sheet is produced which is coated on at least one of its principal surfaces with a layer of a coating, in the solid state, said coating being comprised of an aluminum-based alloy formed from aluminum and silicon, comprising silicon less than 11 wt. %, particularly comprising 7–11 wt. % silicon and 87–93 wt. % aluminum.

In a second stage, the coating layer is heated to a temperature T1 which is greater than the fusion temperature T2 of said coating.

The "fusion temperature T2" is understood to mean the temperature of the onset of fusion of the coating. In practice, an aluminum-based coating such as described hereinabove is in the form of dendrites of aluminum with an inter-dendritic phase and a dendritic phase. The inter-dendritic phase fuses at a temperature lower than the temperature at which the dendritic phase fuses; wherewith the temperature T2 of interest is the fusion temperature of the said inter-dendritic phase.

In a third stage of the fabrication, the coating layer is maintained at the aforesaid temperature T1, or in any event at a temperature greater than T2, for a duration between 0 and 100 sec, preferably between 0 and 10 sec.

In a final stage, the coated metal sheet is cooled to a temperature at least equal to the limiting alloying temperature of alloying between the coating and the steel, and preferably the sheet is cooled to the ambient temperature (room temperature).

The described fabrication method enables a remelting of the aluminum-containing coating.

The production of:

the steel sheet coated on at least one of its principal surfaces with a layer of a coating, in the solid state, said coating being comprised of an aluminum-based alloy comprised of aluminum and silicon, comprising silicon less than 11 wt. %, particularly comprising 7–11 wt. % silicon and 87–93 wt. % aluminum, which production corresponds to the first stage of the inventive method, may be carried out by dip-coating a steel substrate in a fused bath comprising silicon 9–10 wt. %, iron c. 3 wt. %, and the remainder aluminum, and cooling the coated substrate to a temperature less than the fusion temperature of the coating.

It is very important that the steel sheet having an aluminum-containing coating, which coated steel sheet is produced in the first stage of the fabrication method, has a coating layer in the solid state, i.e. that said sheet has been cooled to a temperature less than the fusion temperature of the coating.

A less important factor for obtaining the emissivity characteristics of the inventive metal sheet is for the temperature to which is cooled to be:

several degrees below the fusion temperature of the coating, e.g. 5–10° C. below said fusion temperature; or, e.g.,—ambient (room) temperature.

The temperature T1 which the sheet reaches during the heating carried out in the second stage of the method must mandatorily be greater than the fusion temperature T2 of the coating, in order to ensure re-melting of the coating layer so as to obtain the emissivity characteristics of the coated sheet metal according to the invention.

Preferably, the temperature T1 is between the fusion temperature T2 of the coating layer and 650° C.

The limit of 650° C. allows the cost of the second stage to be limited, and further has the benefit of limiting the phenomenon of alloying between the coating and the steel.

To ensure that every part of the coating layer is re-melted, it is preferable to heat the coated metal sheet to a temperature T1 which is between a temperature 10° C. above the fusion temperature T2 of the coating layer and a temperature 15° C. above said fusion temperature T2 of the coating layer.

This feature enables one to avoid the effect of possible minor temperature nonuniformities due, e.g., to nonuniformity of thickness of the coating layer, or due to peculiarities of the heating system. It is important that the temperature T1 be reached rapidly, so as to limit the phenomena of alloying between the coating and the steel of the substrate. Advantageously, the rate of such heating is in the range 20–100° C./sec.

In a case where the temperature of the coating layer on the metal sheet, which layer is produced during the first stage, is close to the fusion temperature T2 of the coating, one may select a heating rate in the range 20–30° C./sec, because in this case the temperature of the coated sheet only needs to be raised by an amount on the order of 20–50° C.

On the other hand, in a case where the temperature of the coating layer on the metal sheet, which layer is produced during the first stage, is close to ambient temperature, one would choose a heating rate in the range 90–100°C./sec, because in this case the temperature of the coated sheet needs to be raised by an amount on the order of 500 –600° C.

In the third stage of the method, the coating layer is maintained at the said temperature T1 for a duration between 0 and 100 sec, preferably between 0 and 10 sec.

In the final stage of the method, it is possible to begin cooling the metal sheet immediately after all parts of the coating layer reach a temperature T1 greater than the fusion temperature of the coating.

E.g., in a case where the temperature T1 reached by the coating layer during the heating stage (second stage of the method) is 10–15° C. above the fusion temperature of the coating layer, it is possible to eliminate the period of maintenance of the coated sheet at said temperature T1. In any event, according to the invention, such a period of maintenance of the coated sheet at temperature T1 will not be detrimental in a major way provided that it is not longer than 100 sec.

The Applicant has found that if this temperature T1 is maintained for a duration greater than 100 sec, the emissivity of the coating layer will be excessively increased, in the case of standard steel or a type "IF" titanium steel, since the emissivity begins increasing after 10 sec. In the case of nitride case-hardened steels, the presence of the nitrogen retards the alloying phenomenon, and the emissivity is not appreciably increased, but the surface becomes oxidized, wherewith the metal sheet having an aluminum-containing coating turns whitish and eventually yellowish.

Figure 2:
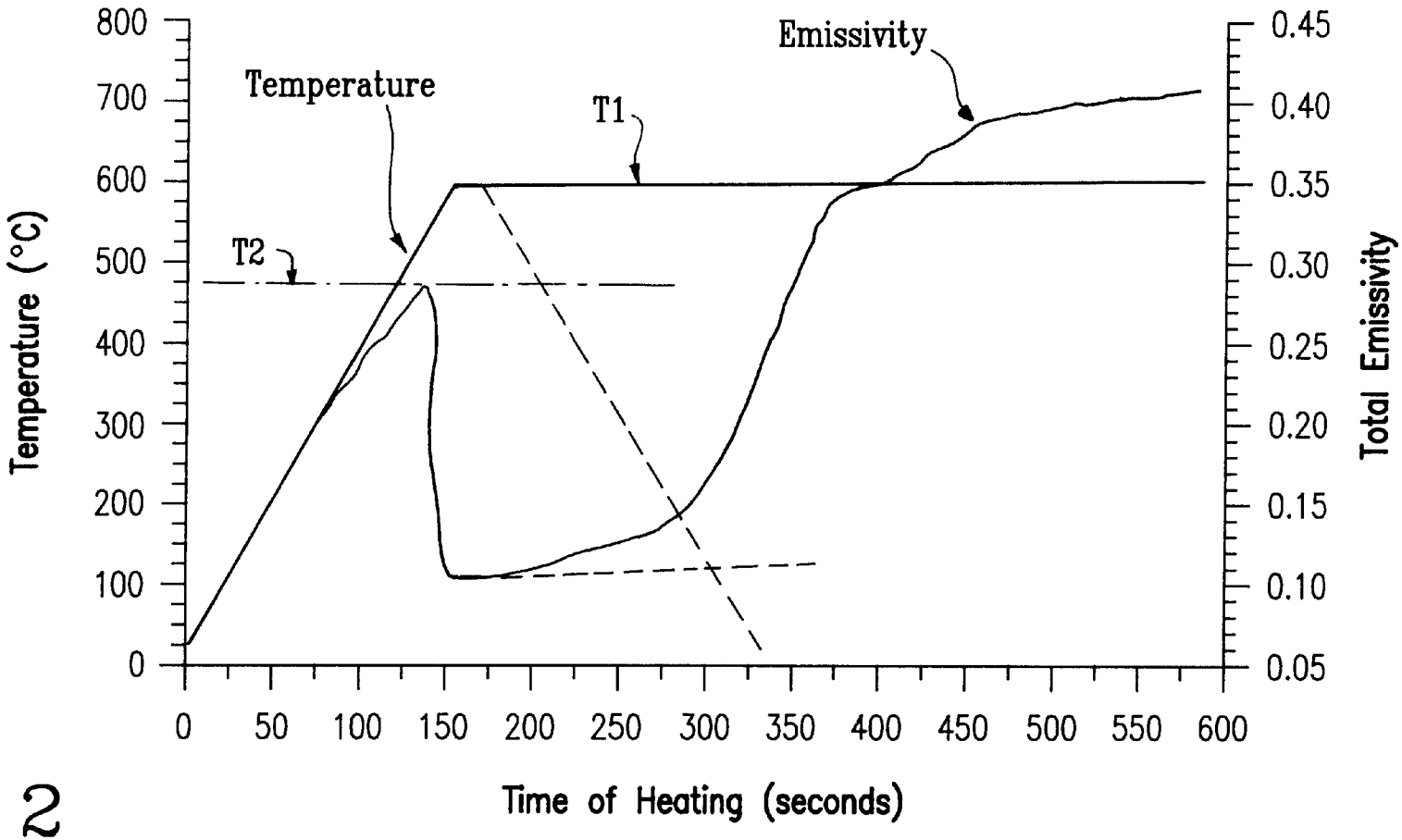
FIGS. 2 and 3 are plots representing the effect on emissivity, of heating a metal sheet having an aluminum-containing coating according to the invention.

This phenomenon, viz., the sharp increase in emissivity after the coated sheet is held more than 100 sec at T1, is quite apparent in FIG. 2, which presents a plot of total emissivity of the coating layer as a function of temperature and of duration of heating.

The plot in FIG. 2 was prepared from an experiment with a metal sheet having an aluminum-containing coating, which sheet comprised a substrate comprised of "IF" titanium steel 0.3 mm thick, coated with a coating 20 micron thick comprised of silicon 9.5 wt. %, iron 3 wt. %, and the remainder aluminum.

This coated steel sheet was heated from ambient temperature until the temperature of the coating layer reached T1=600° C., which was greater than the fusion temperature (T2) of the coating, which temperature T2 was 480° C. in this example; and the coated steel sheet was held at said 600° C. for 450 sec. Throughout the execution of the heating phase and the phase of maintaining the coated sheet at 600° C., the total emissivity of the coating layer was measured in real time, for wavelengths in the range of 1.5–14.5 micron, using a spectroradiometer.

The plot of emissivity vs. time (FIG. 2) shows clearly that, after the fusion temperature (T2) is reached, the emissivity of the coating decreases; however, when the coating layer is maintained at 600° C. for approximately 10 sec, the emissivity begins increasing again, slowly at first, then more rapidly after the coating layer has been maintained at 600° C. for 100 sec.

The Applicant has also found that the described progressive increase in the emissivity is a function only of the duration of maintenance of the coating layer at the temperature T1.

As seen from FIG. 2 (dashed lines), the increase in emissivity can be stopped by cooling the coating layer according to the invention.

Figure 3:
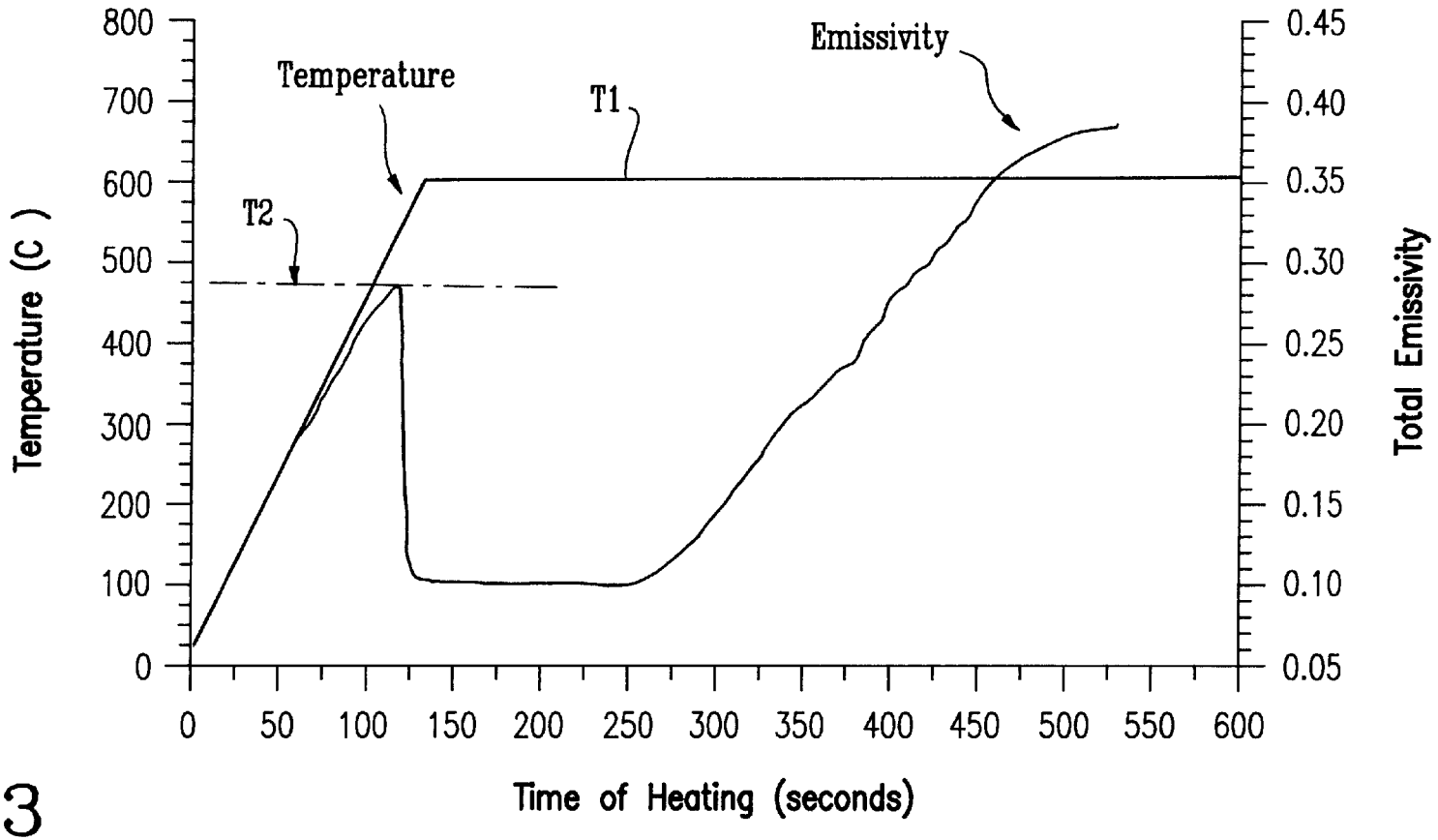

The plot represented in FIG. 3 demonstrates the effect of nitrogen on the phenomenon of alloying of the coating, which effect is per se known in its generalized aspects.

The plot in FIG. 3 was prepared from an experiment with a metal sheet having an aluminum-containing coating, which sheet comprised a substrate comprised of nitride-case-hardened ("re-nitrided") steel with a nitrogen content greater than that of the "IF" titanium steel described supra. The coating layer and the heat treatment were the same as in the preceding experiment.

It is seen clearly from the plot in FIG. 3, in comparison to that in FIG. 2., that the emissivity does not begin to increase in this case until the coating has been held at temperature T1 for 120 sec.

Accordingly, in the final stage of the process the coated metal sheet is cooled to a temperature at least equal to the limiting temperature of alloying between the coating and the steel, and preferably the sheet is cooled to the ambient temperature (room temperature).

This cooling may be natural cooling in the open air, or so-called "forced radiative cooling", or forced-air cooling.

Preferably the cooling of the coated metal sheet is carried out in at least two stages, as follows:

natural cooling from the temperature T1 to the fusion temperature T2 of the coating; followed by forced-air cooling from said fusion temperature to the limiting temperature of alloying between the coating and the steel.

In practice, it is preferable to carry out an initial stage of cooling without contact with the coating layer which is still in a fused state, in order to avoid degradation of the emissivity properties of the coating layer which might result from such contact.

Suitable cooling means for this initial cooling stage are:

natural cooling in air and

"forced radiative cooling" by passing the coating layer close to a refrigerated wall.

The application of forced means of cooling, e.g. with forced air, at least between the fusion temperature of the coating and the limiting temperature of alloying between the coating and the steel, enables any such alloying to be minimized.

The shorter the duration of the thermal cycle (heating, maintaining the temperature, and re-cooling) the better the quality of the inventive metal sheet having an aluminum-containing coating, because thereby in particular the time said coated sheet spends at temperatures above the limiting temperature of alloying between the coating and the steel substrate is shorter, so that the amount of ternary alloy which is developed between the substrate and the coating is less.

The Applicant has found that the metal sheet having an aluminum-containing coating obtained according to the described method not only has a total emissivity lower than that of a comparable coated sheet of the customary type, such as the coated sheet exiting the first stage of the described process, but also the inventive coated sheet has a monochromatic emissivity which is substantially uniform over the wavelength range of 1.5–15 micron.

This characteristic may be seen from FIG. 1, showing the spectral emissivity of:

a metal sheet B having an aluminum-containing coating according to the invention, and a second metal sheet A having an aluminum-containing coating according to the state of the art.

The spectral plot of the emissivity of the coated sheet A according to the state of the art was prepared from a coated sheet comprising a substrate comprised of "IF " titanium steel 0.3 mm thick, coated with a coating 20 microns thick comprised of silicon 9.5 wt. %, iron 3 wt. %, and the remainder aluminum.

The emissivity of this coated sheet A was measured over the range of wavelengths of 1.3–15 microns, which wavelengths are characteristic of the infrared band.

As may be seen, the monochromatic emissivity of the coated sheet A is greater than 0.35 for wavelengths between 2 microns and 3.6 microns, is below 0.15 only at wavelengths above 7.5 microns, and is everywhere above 0.07.

Accordingly, a heat shield produced from such a coated sheet will be suitable to insulate against sources having their radiative emissions of energy principally at wavelengths above 7.5 micron, corresponding to temperatures below 500° C. in the case of a gray body which may be deemed similar to automotive exhaust conduits.

On the other hand, the heat shielding will be less effective in the case of sources having appreciable emissions at wavelengths below 7.5 microns, corresponding to automotive exhaust conduits operating at temperatures above 500° C., viz. the hottest parts of exhaust systems, e.g. the catalytic unit.

The second spectral plot, a spectral plot of the emissivity of a coated metal sheet B according to the invention, was prepared from a coated sheet comprising a substrate comprising a sheet comprised of "IF" titanium steel 0.3 mm thick, coated with a coating 20 microns thick comprised of silicon 9.5 wt. %, iron 3 wt. %, and the remainder aluminum. After being cooled to ambient (room) temperature, this coated sheet was reheated to 600° C., maintained at 600° C. for 5 sec, and then cooled by natural air cooling back to ambient temperature. The emissivity of this coated sheet B was also measured over the wavelength range 1.3–15 micron.

As may be seen, the monochromatic emissivity of coated sheet B according to the invention was lower than 0.15 over the entire wavelength range 1.5–15 micron; in particular said emissivity was in the range 0.10–0.15 for wavelengths of 1.5–4.5 microns, was in the range 0.07–0.10 for wavelengths of 4.5–6.5 microns, and was below 0.7 for wavelengths of greater than 6.5 microns.

Accordingly, a heat shield produced from such a coated sheet will be well suited to insulate against sources having their principal radiative emissions of energy in the entire wavelength range of 1.5–15 microns, i.e. over the entire infrared band.

Such a coated sheet according to the invention is thus suitable for producing heat shields regardless of the temperature attained by the thermal source to be insulated against; e.g. in the case of an automotive exhaust conduit system the sheet is suitable for insulating with respect to any part of such system, even the hottest parts.

The inventive coated sheet metal has emissivities which are only slightly higher than those of aluminum, namely higher by on the order of 0.02–0.03 for wavelengths in the range of 5.5–15 microns, and higher by on the order of 0.03–0.05 for wavelengths in the range of 1.5–5.5 microns.

KEY to FIG. 1:

Ordinate: Emissivité=Emissivity.

Abscissa: Wavelength (micron). Tóle aluminiée A=Metal sheet A having an aluminum-containing coating.

KEY to FIGS. 2 and 3:

Emissivité=Emissivity.

Abscissa: Time of heating (seconds).

What is claimed is:

1. A steel sheet having on at least one of its principal surfaces a layer of a coating, the layer of coating comprising: an aluminum-based alloy including aluminum and silicon, wherein the silicon is present in an amount less than 11 wt. %, wherein after said layer of aluminum-based alloy is applied to said steel sheet, the coated sheet is heated to a temperature above the fusion temperature of said aluminum-based alloy for no more than 100 seconds to remelt the layer while limiting alloying between the layer and the steel forming the sheet and wherein a surface of the layer of coating has a monochromatic emissivity less than 0.15 for all wavelengths in the range of 1.5–15 microns.

2. The steel sheet according to claim 1, wherein the coated sheet is heated to a temperature no greater than 650° C. and the surface of the layer of coating has a monochromatic emissivity less than0.10 for all wavelengths in the range of 5–15 microns, and a monochromatic emissivity in the range 0.10–0.15 for all wavelengths in the range of 1.5–5 microns.

3. The steel sheet according to claim 1, wherein the layer of coating comprises an aluminum-based alloy including silicon in an amount of 7 to less than 11 wt. % and aluminum in an amount of 87–93 wt. %.

* * * * *